United States Patent [19]

Siracusano

[11] 4,350,731

[45] Sep. 21, 1982

[54] NOVEL YARN AND FABRIC FORMED THEREFROM

[75] Inventor: Elizabeth Siracusano, Schenectady, N.Y.

[73] Assignee: Albany International Corp., Albany, N.Y.

[21] Appl. No.: 271,590

[22] Filed: Jun. 8, 1981

[51] Int. Cl.[3] ..... B32B 5/06

[52] U.S. Cl. ..... 428/234; 57/210; 57/230; 162/DIG. 1; 428/257; 428/373; 428/377

[58] Field of Search ..... 428/224, 234, 257, 373, 428/377; 57/210, 230; 162/DIG. 1

[56] References Cited

U.S. PATENT DOCUMENTS

| | | | |
|---|---|---|---|
| 2,769,300 | 11/1956 | Luttge | 57/210 |
| 4,093,512 | 6/1978 | Fleischer | 428/377 |
| 4,202,382 | 5/1980 | Westearl | 428/377 |
| 4,283,454 | 8/1981 | Buchanan | 428/300 |

*Primary Examiner*—James J. Bell

*Attorney, Agent, or Firm*—Kane, Dalsimer, Kane, Sullivan and Kurucz

[57] ABSTRACT

There is disclosed a composite yarn having lengthwise tensile strength and transverse resiliency. The yarn comprises a high tensile strength core yarn covered by an elastomeric filament. The yarn is useful to prepare compressible fabrics and is particularly useful for the making of papermaker's wet press felts.

7 Claims, 8 Drawing Figures

NOVEL YARN AND FABRIC FORMED THEREFROM

BACKGROUND OF THE INVENTION

Field of the Invention

This invention relates to yarn and fabrics formed therefrom and, more particularly, to a composite yarn and compressible fabric made therefrom.

SUMMARY OF THE INVENTION

The invention comprises a composite yarn, which comprises; a core yarn selected from the class consisting of high tensile strength, non-elastic textile yarns, covered with an elastomeric filament. In a preferred embodiment, the lengthwise axis of the elastomeric filament is at an angle non-perpendicular to the lengthwise axis of the core yarn.

The composite yarns of the invention are useful in fabricating compressible fabrics and in particular wet-press fabrics for use in wet press papermaker's belts. The invention also comprises the compressible fabrics, wet press fabrics and papermaker's belts made from the composite yarns of the invention.

The term "non-elastic textile yarn" as used throughout the specification and claims means a textile yarn having a relatively low degree of extensibility, for example on the order of less than about 50 percent of original length at break.

The term "elastomeric" as used herein means a filament having a relatively high degree of reversible extensibility, for example a filament which at room temperature can be stretched repeatedly to at least twice its original length and, upon immediate release of the stress, will return with force to its approximate original length (ASTM D 883-65T). Synthetic polymers considered to be elastomeric, at least in some of their forms, are represented by butadiene-acrylonitrile copolymers, chlorinated polyethylenes, chloroprene polymers, chlorosulfonyl polyethylenes, ethylene ether polysulfides, ethylene polysulfides, ethylene propylene copolymers, ethylene propylene terpolymers, fluorinated hydrocarbons, fluorosilicones, isobutylene-iosprenes, polyacrylates, polybutadienes, polyepichlorohydrins, polyurethanes, styrene-butadiene copolymers and the like.

The term "compressible fabric" is used herein to mean a fabric of a given, natural caliper which may be compressed under a weight to a smaller caliper and which will return to substantially its natural caliper when the weight is removed.

The resiliency to recover its natural caliper is essential for compressible fabrics of the invention.

DETAILED DESCRIPTION OF THE PREFERRED EMBODIMENTS OF THE INVENTION

Those skilled in the art will readily appreciate the invention from the following discussion of the preferred embodiments when read in conjunction with the accompanying drawings of FIGS. 1–5 inclusive.

Figure 1:
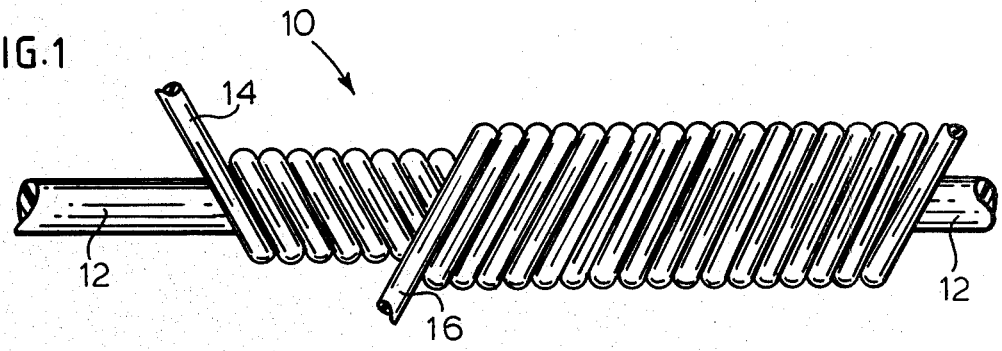
FIGS. 1–3 are isometric views of portions of embodiment yarns of the invention.

FIG. 1 is an isometric view of a preferred embodiment yarn 10 of the invention which comprises a core 12 wrapped in a first direction with elastomeric filament 14 and in a second, opposite direction with elastomeric filament 16. The filaments 14, 16 each have a lengthwise axis which is at an angle non-perpendicular to the lengthwise axis of the core 12 yarn. Core 12 is a high-tensile strength, non-elastic monofilament yarn. Representative of such core 12 yarns are monofilament yarns prepared from synthetic polymeric resins such as polyamide, polyester, polypropylene, polyimide, polyaramid and like resins. Alternatively, the core 12 yarn may be a spun yarn, spun from, for example, fibers formed from metal (e.g., Chromel R. Rene 41, Hostelloy B), glass (e.g., B glass and E glass), graphite, asbestos, silicon, carbide (e.g., those formed by deposition of silicon halides and hydrocarbons on tungsten filaments), boron, nitride, ceramic, polyimide (e.g., polypyromellitimide of p-phenylene diamine), polyamide polyester (e.g., polyethylene terephthalate), polybenzimidazole (e.g. that formed from diaminobenzidine and diphenyl isophthalate), polyphenylene triazole, polyoxadiazone (e.g. poly-1,3,4 oxadiazoles), polythiadiazole, polyaramid [e.g., poly(p-phenylene terephthalamide) and poly(p-phenylene isophthalamide)], polyacrylic, novoloid, wool, like fibers and blends thereof.

The core 12 yarn may also be a multi-filament yarn prepared from filaments of the materials described above for forming spun yarns.

The elastomeric filaments 14, 16 may be formed from any of the known filament forming, synthetic elastomers. Representative of preferred elastomeric filaments are filaments of SBR rubber, non-cellular polyurethanes, butadiene-acrylonitrile copolymers and the like. The elastomeric filaments 14, 16 completely cover the core 12. The preferred use of two separate 14, 16 filaments wrapped about the core 12 from opposite directions helps to give the composite yarn 10 a balanced structure which will not crimp or kink when woven into a fabric. A balanced yarn structure is also achieved by adjusting the twist levels of the component yarns and filaments and the filament weights from each wrapping direction as will be discussed more fully hereinafter.

Figure 2:
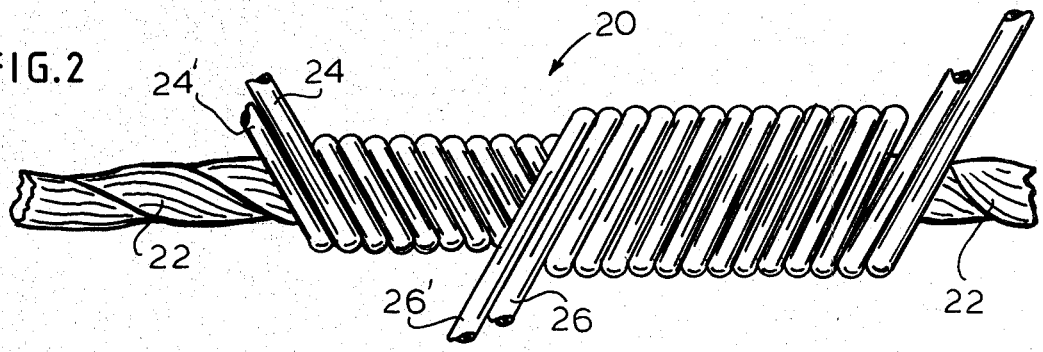

FIG. 2 is an isometric view of another embodiment yarn 20 of the invention having a core 22 of a multifilament yarn wrapped with elastomeric filaments 24, 24', 26 and 26'. Four elastomeric filaments are employed in contrast to 2 used in composite yarn 10, but the yarn 20 structure is balanced in part by wrapping filaments 24 and 24' from a first direction and filaments 26, 26' from a second, different direction over the core 22 yarn.

Figure 3:
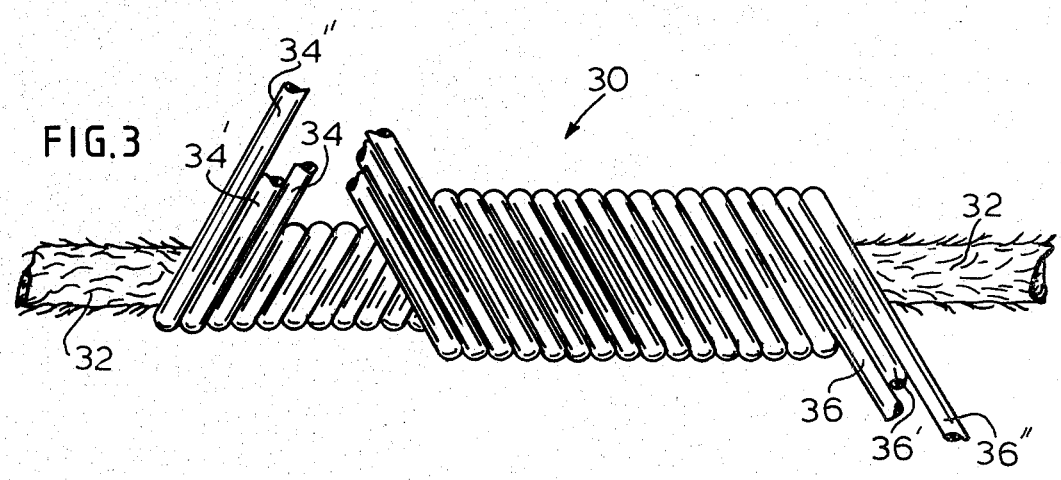

FIG. 3 is an isometric view of still another embodiment yarn 30 of the invention having a core 32 of a spun textile yarn wrapped with six elastomeric filaments, three (34, 34' and 34'') wrapped from a first direction and three (36, 36' and 36'') wrapped from an opposite direction. In general, as the thickness of elastomeric filament coverings increase the compressibility and resiliency of the fabric made from the composite yarns increases. In this way, compressibility of the desired fabric may be controlled and selected to some degree by choice of the filament denier and the number of covering layers (a double layer is shown in the embodiment yarns 10, 20, 30 but additional layers may be used).

The degree of compressibility in the fabric made from yarns of the invention may also be at least partially controlled by the nature or elastic properties of the filaments used to cover the non-elastic core yarn. More specifically, compressibility is higher when more elastic filaments are used. Poylurethanes normally possess an advantageous stretch of from about 600 to 700 percent and for this reason the polyurethane filaments such as the commercially available Lycra (spandex) polyurethane filaments are preferred as the elastomeric filament components of the composite yarns of the invention.

The denier of the core yarns 12, 22, 32 and the filament coverings 14, 16, 24, 24', 26, 26', 34, 34', 34", 36, 36' and 36" is not critical and any commercially available deniers may be advantageously employed. Preferably such deniers are selected so as to provide a composite yarn of the invention having a denier within the range of from about 1,200 to about 13,000. The base weight then for a composite yarn of the invention desired for a particular application determines the size and weight of the yarn component elements. Preferably, the majority (more than 50 percent) of the total yarn weight is provided by the elastomeric filament material to maximize the yarn's transverse resiliency characteristics, without hindering the strength properties of the basic structure. Of course, the composite yarn must have sufficient core material to provide a desired tensile strength for a given application. Optimum ratios of core and covering weights will vary depending on the desired application of the yarns, and may be determined by a simple trial and error technique without undue experimentation.

The techniques and apparatus for covering core yarns by wrapping with secondary yarns or filaments is well known and need not be recited here in detail. In general, the elastomeric filaments are wrapped about the core yarn on a covering machine which includes a hollow spindle with rotating yarn supply bobbins supported thereon. The non-elastic core yarn is fed through the hollow spindle and the elastomeric filaments are withdrawn from the alternate direction rotating supply bobbins and wrapped about the corre yarn as it emerges from the hollow spindle. The core yarn is preferably under a slight tension during the covering procedure and the filaments are laid down in a side by side array. The number of wraps per inch will depend on the denier of the covering filaments but should be sufficient to cause the wrapped filaments to lay close to the core and adjacent wraps when tension on the core yarn is relaxed.

The filament covering yarns are preferably under "O" twist. However, if they are twisted, it is advantageous that the twist be balanced or equalized in the final yarn structure by the covering structure, for example, in the embodiment yarn 10, if the filament 14 has a given twist in the covering, then the filament 16 should have an equal twist. Since the coverings 14, 16 are laid down in opposite directions, the twist in each filament is neutralized in the final yarn structure of the yarn 10. This balanced structure in regard to twist provides a yarn readily used to weave the fabrics of the invention. Similarly, the yarns 14, 16 should be of equal weights to provide the desired balance in the yarn 10. Those skilled in the art will appreciate that these structural principals will apply also to the embodiment yarns 20 and 30.

The yarns 10, 20 and 30 are characterized in part by a high tensile strength (imparted by the core yarn) and transverse (to the core axis) resiliency due to the elastomeric wrapping. For this reason, the yarns 10, 20 and 30 are especially useful as wrap and/or filling yarns in woven fabrics subjected to compression in use. One such fabric is that used to fabricate wet press felts used in papermaking machines.

Figure 4:
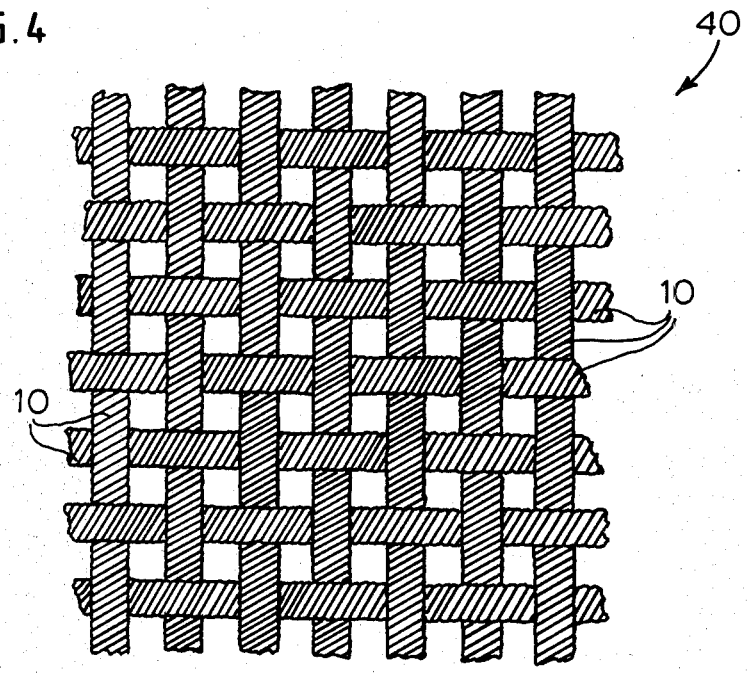
FIG. 4 is an enlarged top-view of an embodiment fabric woven from a yarn of the invention.

FIG. 4 is an enlarged top view of a simple fabric 40 made up of warp and filling yarns 10. A simple weave is shown, but those skilled in the art will appreciate that the fabric 40 may be a complex weave or any weave conventionally used to make a wet press felt fabric. The base fabric 40 may have attached to its surface by needling, a web of carded nylon, polyester acrylic or like textile fibers. The needling operation will create a mechanical felted surface ideally suited for a wet felt for use in the press section of a papermaking machine.

Figure 5:
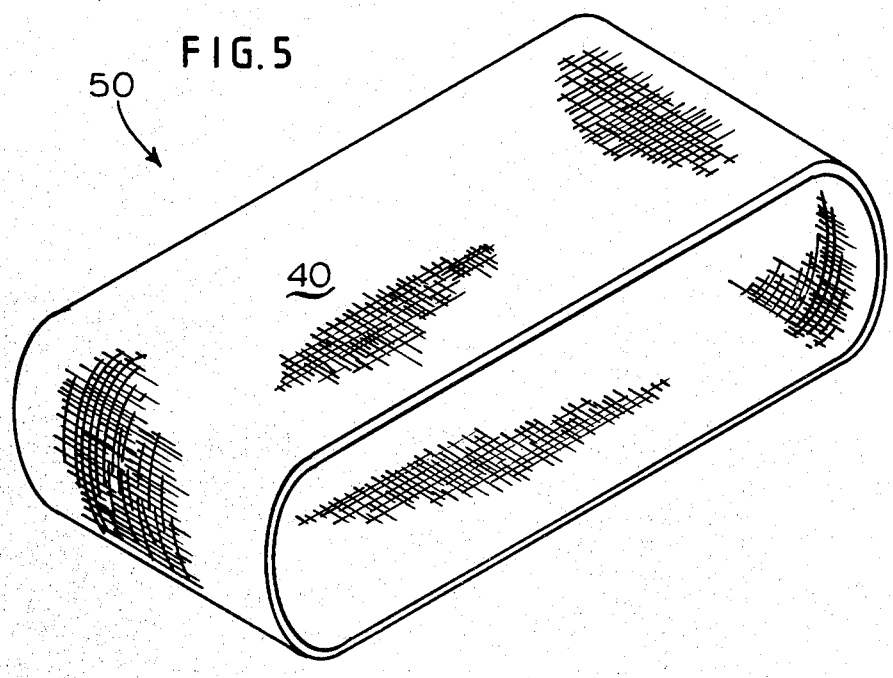
FIG. 5 is an isometric view of an embodiment wet press belt made from fabric of the invention.

The ends of the fabric 40 may be made endless by conventional seam joining to make an endless wet press belt 50 as shown in FIG. 5. As a wet press felt on a papermaking machine, the belt 50 performs well and resists compaction. The fabric 40 may also be made endless by weaving it as a tubular structure in an appropriate loom, eliminating the need for a seam.

As mentioned above, the compressive character of fabrics made from the yarns of the invention may be controlled in a variety of ways. For example, this may also be accomplished by regulating the degree of tightness in the fabric weave.

Figure 6:
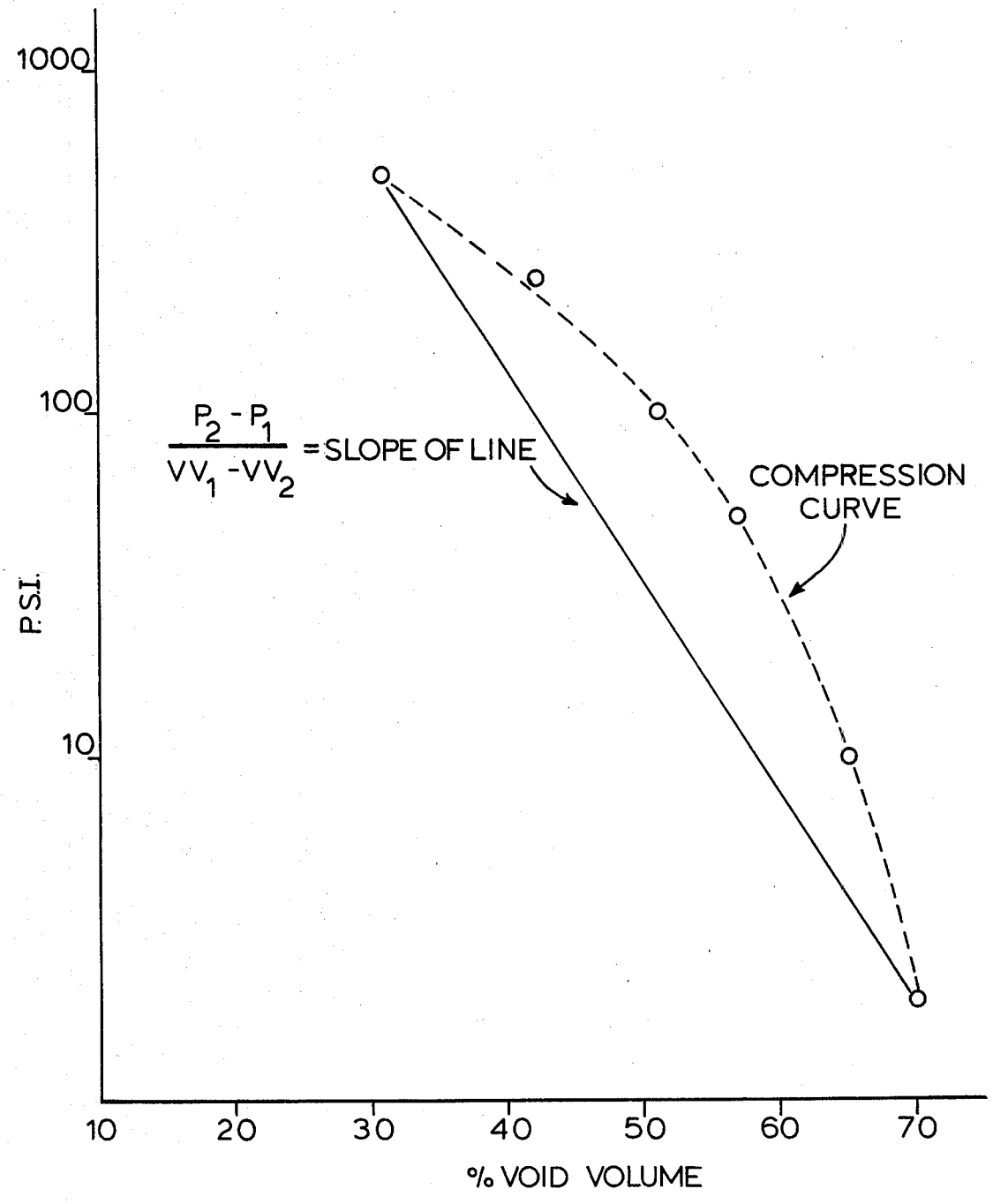
FIG. 6 is a sample slope calculation.

The following example describes the manner and process of making and using the invention and sets forth the best mode contemplated by the inventors of carrying out the invention but is not to be construed as limiting. Compressibility and resiliency of fabrics was determined by subjecting samples to a cyclic compression force of 500 psi and measuring the resistance with an Instron. The compression head of the Instron briefly penetrates the fabric a number of times at a given frequency to a given load. The caliper vs. pressure is measured and recorded. From this data, certain mathematical techniques manipulate the data to derive three significant values for describing the wet felt compressibility and resiliency behavior in terms of void fraction. The values are as follows:

1. Slope of compression curve is a direct indication of the compressibility of the fabric. Slope is calculated by assuming a straight line through the end points of the compression curve and evaluating the ratio of change in pressure and void volume. The greater the numerical value, the steeper the curve and the more incompressible the felt. A sample of the slope calculation is shown in FIG. 6. The slope of the line is determined from the formula:

$$\frac{P_2 - P_1}{VV_1 - VV_2}$$

wherein $P_1$ is the initial pressure, $P_2$ is the highest pressure, $VV_1$ is the initial void volume (%) and $VV_2$ is the final void volume (%).

Figure 7:
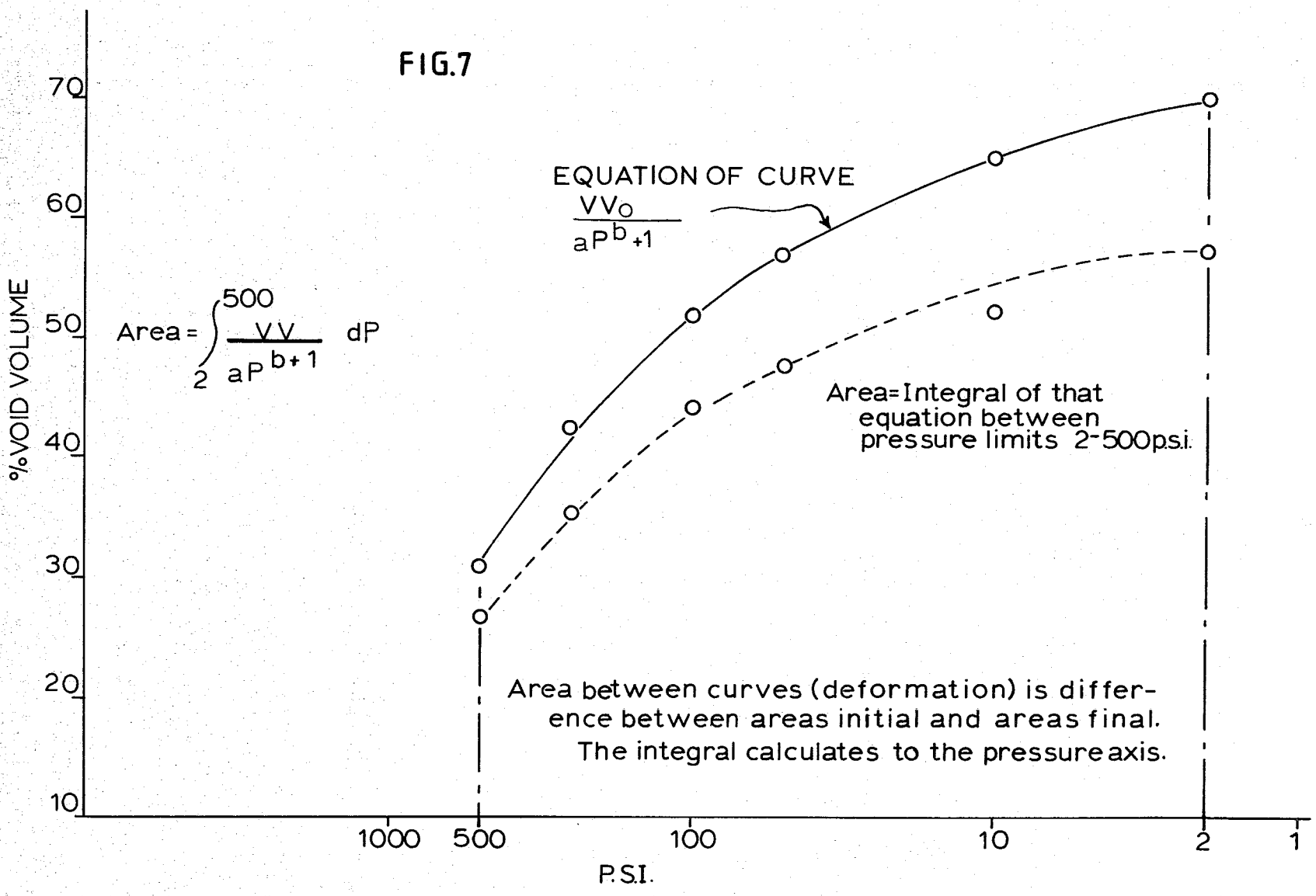
FIG. 7 is a sample area calculation.

2. Area between the compression curves is a work term measuring the ability of the fabric structure to resist deformation. The calculation is shown in FIG. 7 and is determined by the following Simpson's approximation:

$$\text{Area} = \int_{2}^{500} \frac{VV}{aP^b + 1} \cdot dP$$

wherein VV is the void volume, Pispressure, a and b are constants determined experimentally.

3. Position or average area of compression curves describes the openness of the felt with respect to void volume. This number is calculated simply by averaging the initial and final areas.

EXAMPLE 1

A composite yarn is made by covering a 160 denier polyamide (Nylon 66) monofilament with two separate filaments of Lycra spandex (1120 denier) wrapped on in opposite directions in the manner shown in FIG. 1. The composite yarn has a denier of 5600, and a tenacity (grams/denier) of 0.6.

A two layer base fabric is made by weaving the above-described composite yarns in the top layer of a simple base weave (14 ends/inch). To the base weave there is needled a batt of non-woven textile staple fibers (polyamide, nylon 6,12) having a weight of 580 grams/m$^2$. The resulting fabric is heat set at 250° F. and made endless to obtain a wet-press belt for use on a papermaking machine. The air permeability, compressibility, resiliency and caliper of the fabric is shown in Table 1, below.

For comparative purposes, another fabric and papermaker's belt is prepared following the procedure described above, except that the yarns employed are 2040 denier polyamide (Nylon 6,6) multifilament yarns. The air permeability, compressibility, resiliency and caliper of this comparison fabric are also given in Table 1, below.

TABLE 1

| | FABRIC OF THE INVENTION | COMPARISON FABRIC |
|---|---|---|
| Caliper | 0.147" | 0.155" |
| Air Permeability | 72 cfm@.5"$H_2O$ | 87 cfm@.5"$H_2O$ |
| Resiliency | | |
| (Slope) 500 cycle | 24.06 | 29.38 |
| 1st cycle | 16.37 | 18.88 |
| Compaction | 7.69 | 10.50 |
| Position | 223.8 | 250.7 |
| Area | 46.8 | 40.5 |
| 1 cycle | 70.8 | 73.3 |
| $VV_I/VV_C$ | 40.4 | 46.9 |
| 500 cycle | 55.4 | 58.2 |

TABLE 1-continued

| | FABRIC OF THE INVENTION | COMPARISON FABRIC |
|---|---|---|
| $VV_I/VV_C$ | 34.7 | 41.3 |

(VV = void volume;
I = initial state at 2 psi loading;
C = compressed state at 500 psi loading)
The void volume (VV) is determined by the formula:

$$\text{V.V.} = \frac{1 - 0.012\ (\text{Total weight, oz/sq. ft.})}{\text{specific gravity} \times \text{caliper (inches)}} \times 100$$

Figure 8:
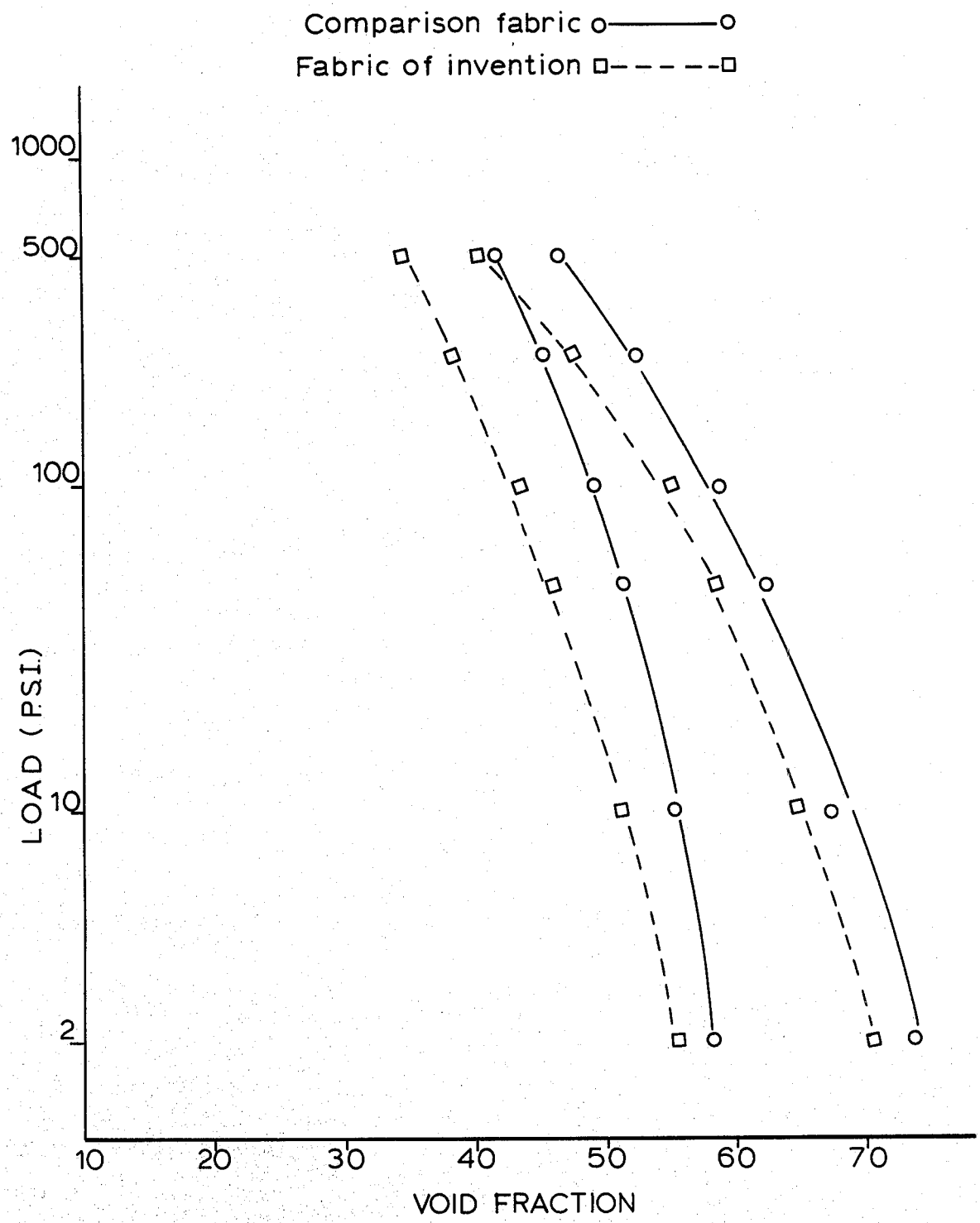
FIG. 8 is a graphical representation of differences between the fabric of the invention and a comparison fabric.

The differences between the fabric of the invention and the comparison fabric are shown in the Table 1 and in FIG. 8.

The area value and position value indicate that the fabric employing the invention results in a denser structure. The yarn composite of the invention exhibits improved resiliency characteristics. Both fabrics maintained an equivalent void fraction level under 2 psi loadings but the yarn of the invention employed in the base did compress to a lower void fraction under pressures of 500 psi. This result is noted when comparing the slope values of both fabrics. The fabric of the invention has lower slopes throughout the test, therefore is a more compressible structure with a greater ability to recover from the compressive force.

The fabric of the invention, when made up into papermaker's felt, performs well on a papermaker's machine in the wet press section, resisting compaction.

Those skilled in the art will appreciate that many modifications may be made to the above-described preferred embodiments without departing from the spirit and the scope of the invention. For example, in the embodiment yarn 20, the filaments 24 and 26 could run in the same direction and filaments 24' and 26' could run in the opposite same direction so that there is a 4-layer wrap. In a similar manner, the embodiment yarn 30 could be a 6-layer wrap with adjacent filaments 34, 34' and 34" alternating directions and filaments 36, 36' and 36" alternating in directions.

What is claimed is:

1. A composite yarn, which comprises:

a core yarn selected from the class consisting of high tensile strength, non-elastic textile yarns, covered with an elastomeric filament.

2. The yarn of claim 1 wherein the elastomeric filament is a polyurethane.

3. The yarn of claim 1 wherein the core yarn is a polyamide.

4. A composite yarn, which comprises;

a core yarn selected from the class consisting of high tensile strength non-elastic, monofilament, multifilament and spun yarn, wrapped in a first direction and in a second direction with an elastomeric filament, the lengthwise axis of said wrappings being at an angle non-perpendicular to the lengthwise axis of the core yarn.

5. A fabric which comprises interwoven yarns as described in claim 4.

6. A wet press papermaker's felt made from an endless fabric of claim 5.

7. A wet press papermaker's felt of claim 6 which further comprises a batt of non-woven staple textile fibers needled to a surface of the fabric.

* * * * *